United States Patent [19]

Lawrence

[11] 4,277,062

[45] Jul. 7, 1981

[54] LEG STRETCHING EXERCISE

[76] Inventor: Mark Lawrence, 212 Church St., White Plains, N.Y. 10603

[21] Appl. No.: 116,007

[22] Filed: Jan. 28, 1980

[51] Int. Cl.[3] ..... A63B 23/04; A63B 21/12

[52] U.S. Cl. ..... 272/126; 272/134

[58] Field of Search ..... 272/126, 127, 128, 134, 272/137, 143, 145, 140, 70, 71, 72, 130

[56] References Cited

U.S. PATENT DOCUMENTS

| | | | |
|---|---|---|---|
| 2,834,694 | 9/1974 | Pridgen | 272/118 |
| 3,638,939 | 2/1972 | Langley | 272/127 |
| 3,752,474 | 8/1973 | Moccabet | 272/126 |
| 4,046,373 | 9/1977 | Kim | 272/63 |
| 4,111,415 | 9/1978 | Reitano | 272/126 |
| 4,125,258 | 11/1978 | McArthur | 272/144 |
| 4,132,404 | 1/1979 | Wilson | 272/127 |
| 4,139,193 | 2/1979 | Felber | 272/146 |
| 4,149,713 | 4/1979 | McLeod | 272/134 |
| 4,205,839 | 6/1980 | Best | 272/126 |

FOREIGN PATENT DOCUMENTS

| | | | |
|---|---|---|---|
| 675742 | 7/1952 | United Kingdom | 272/145 |

*Primary Examiner*—Richard J. Johnson
*Attorney, Agent, or Firm*—Spellman, Joel & Pelton

[57] ABSTRACT

A leg stretching exercising device comprises a platform having an upwardly extending backrest at one end thereof, at least one handle opposite the backrest and extending outwardly from the platform. A bar including telescoping inner and outer end portions extends outwardly from the platform at each end substantially in alignment with the backrest and perpendicular to the handle. The telescoping members are longitudinally adjustable and include means for fixing the length of said members. A pulley member is connected to the end of each inner telescoping member and includes a rope-like member having a stirrup at one end for locking one's foot and a handle at the other end. In operation, an individual adjusts the telescoping members to the proper length and sits on the platform against the backrest gripping the pulley handles which are pulled together stretching one's legs which are placed in the stirrups. The handle is gripped if an individual is stretching only one leg with the pulley.

6 Claims, 5 Drawing Figures

10
11
12
13
14
15
16
17
18
19
20
23
24
25
26
27
28
29
30a
30b
31a
31b
32
32a
32b
33a
33b
34a
34b
35a
35b
40
41

34a
36a
37a 30b
24
32b
34b
36b
37b
33b
35a
27
19
50
18
13
15
17
12
16
14
33a
35a
26
23
32a
34a
30a

LEG STRETCHING EXERCISE

BACKGROUND OF THE INVENTION

This invention relates to exercise devices and particularly to leg stretching exercising devices.

The prior art includes various patents pertaining to exercise devices but none of the devices are particularly suitable for stretching the legs apart for the martial arts or ballet dancing. U.S. Pat. No. 3,638,939 to C. J. Langley discloses a simple bar-like device which includes rollers at each end thereof and an intermediate handle. The device is positioned between one's legs and pulled towards the abdomen forcing the legs further and further apart, thus stretching the muscles associated therewith.

U.S. Pat. No. 3,834,694 to R. H. Pridgen relates to an apparatus utilizing pulleys wherein one leg is strapped to a mattress and the other leg is coupled to weights by an overhead pulley system. A rope is also coupled to the weights through a one-way clutch. The same patent further discloses a post which is gripped while one moves his legs back and forth against spring bars mounted to the post. Also in the same general area is U.S. Pat. No. 4,046,373 to C. C. Kim which discloses a multipurpose frame for stretching one's legs and U.S. Pat. No. 4,111,415 to A. Reitano which discloses utilizing hand grips and foot grips to develop particular muscles for karate.

U.S. Pat. No. 4,132,404 to R. L. Wilson discloses a leg stretching apparatus comprising two movable platforms having ball casters with free movement in opposite directions, said platforms being joined by an appropriate coupling means. Finally, U.S. Pat. No. 4,139,193 to D. P. Felber et al discloses a kick training aid for karate comprising an adjustable pole with a foot-piece on the top thereof mounted for universal movement on a base, said pole being extensible to accommodate individuals of different heights.

The present invention comprises a relatively inexpensive leg exercising device which may be utilized by individuals of different sizes, is adjustable and permits extension of one's legs to an angle of approximately 180°. Either one or both legs may be exercised at one time. The apparatus also is readily collapsible to facilitate shipping and may be easily assembled.

Accordingly, an object of this invention is to provide a new and improved leg stretching exercise device.

Another object of this invention is to provide a leg stretching device which is inexpensive and easy to use wherein an individual's legs may be stretched into a "split" position.

A more specific object of this invention is to provide a new and improved leg stretching exercise device of an adjustable nature which includes telescoping bars on a support platform having pulleys affixed to the end thereof for spreading one's legs apart to develop the leg muscles.

BRIEF DESCRIPTION OF THE DRAWINGS

Other objects and advantages may be seen from the following description when viewed in conjunction with the accompanying drawings wherein.

DETAILED DESCRIPTION OF THE INVENTION

Figures 1, 2, 3:
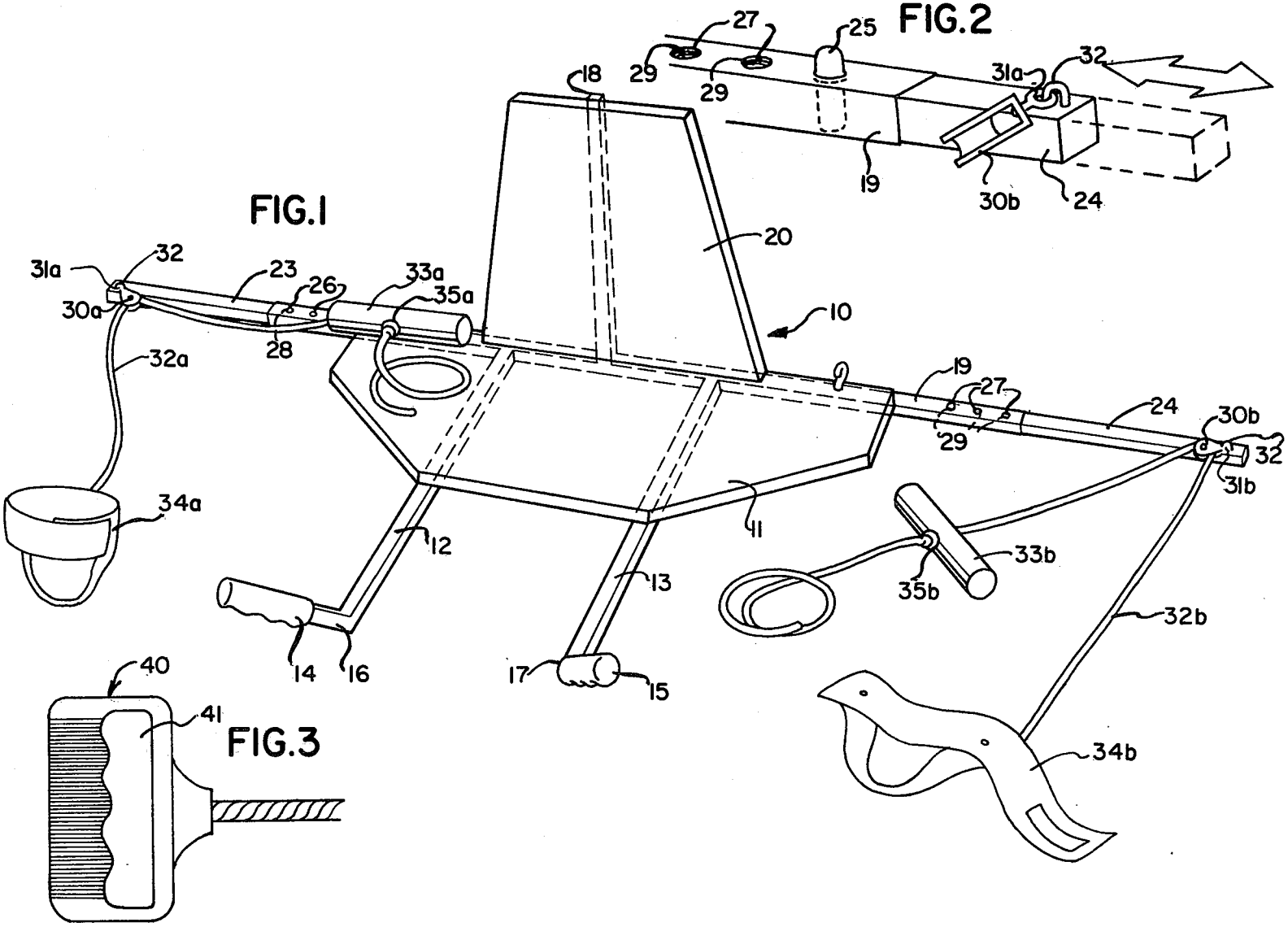
FIG. 1 is a perspective view of the leg stretching exercise device.
FIG. 2 is an enlarged view of the pulley and telescoping bar arrangement to illustrate the operation thereof.
FIG. 3 is a view of an alternate handle grip.

Referring now to FIG. 1 of the drawings, the leg stretching exercise device 10 comprises a horizontal platform 11 having spaced support members 12 and 13 mounted to the lower portion thereof. A handle 14 and 15 is mounted to each end 16 and 17 respectively of the supports which extend outwardly from the platform 11. The handles 14 and 15 are positioned at an angle of approximately 70° to a vertical plane extending through the support members 12 and 13 to facilitate proper gripping.

A backrest 20 with a vertical supporting bar 18 extends upwardly from the rear portion of the platform 11 so that the user may prop his back against said support 20. A bar 19 extends substantially parallel to the rear edge of the platform 11 in each direction with the supporting member mounted perpendicularly thereto. The bar 19 is a channel member which includes telescoping outer portions 23 and 24, respectively, which may be extended to conform to the size of the user. A plurality of corresponding apertures 26 and 27 are provided respectively in each end of the bar 19 and a similar set of apertures 28 and 29 are provided in the telescoping bars 23 and 24 respectively. A pin 25 is supplied to engage the corresponding apertures in the bars and prevent further movement of the telescoping members 23 and 24 within the permanently fixed member 19.

A swiveling pulley **30*a* and 30*b* having an eye 31*a*, 31*b* is mounted to a fixed hook 32 on the end of the members 23 and 24. A rope 32*a* and 32*b* is provided about each of the pulleys 30*a* and 30*b* and includes a handle 33*a* and 33*b* at one end and a stirrup 34*a* and 34*b*** at the other end thereof.

The handle 40 shown in FIG. 3 with a contoured aperture 41 for ease of gripping may be utilized in place of the handles **33*a* and 33*b* shown in FIG. 1. The latter handles comprise an elongated wood bar having an aperture 35*a* and 35*b* extending therethrough to receive the ropes 32*a* and 32*b* respectively. The ropes 32*a* and 32*b* are knotted at both sides of the handles 33*a* and 33*b*** to lock the handles in place at a predetermined rope length.

Figures 4, 5:
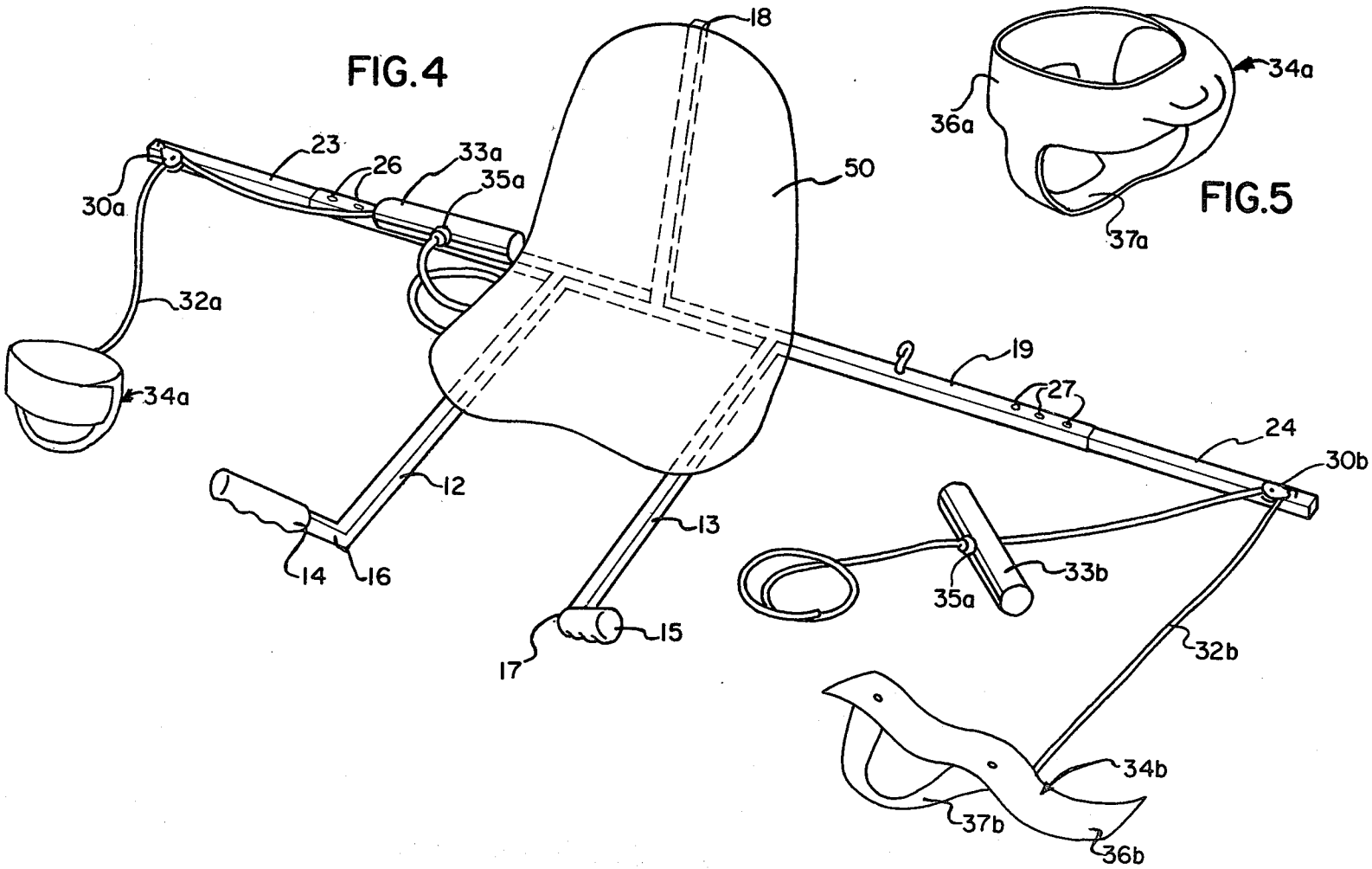
FIG. 4 is a perspective view of an alternate embodiment of the invention, and, FIG. 5 is an enlarged view of the stirrups which are coupled to the end of the pulley line.

In an alternate embodiment shown in FIG. 4, the platform 11 and backrest 20 shown in FIG. 1 may be combined into a molded seat 50 with the other elements remaining substantially the same. The molded seat 50 may be shaped to provide support and comfort to an individual during an exercise routine.

FIG. 5 depicts a typical stirrup **34*a* comprising an upper rectangular portion 36*a* which is wrapped around the ankle and a downwardly extending loop 37*a* which supports the foot. The rope 32*a* is fastened to the upper portion 36*a*** which also includes fastening means such as a "Velcro" fastener for attaching the ends thereof about one's ankle.

The stirrups **34*a* and 34*b* are fastened about one's feet. The individual then grasps the hand grips 33*a* and 33*b* and pulls his legs apart to the extent permitted, the telescoping arms having previously been locked in position with pin 25 in accordance with the individual's size. The handles 14 and 15** are utilized when one is pulling back a single leg and wishes to grip a fixed number with his other hand.

It is understood that the above-described arrangements are merely illustrative examples of the application. Numerous other arrangements may be readily devised by those skilled in the art which will embody the principles of the invention and fall within the spirit and scope thereof.

I claim:

1. A leg stretching exercise device comprising:

a platform having an upright rear portion forming a backrest, a pair of spaced support members extending outwardly from beneath the platform substantially perpendicular to the backrest, each of said members having an end portion extending upward in a divergent direction and at an acute angle, a support member extending substantially along the plane of the backrest beneath the platform and outwardly therefrom, the end portions thereof having a tubular configuration with a plurality of spaced apertures along the upper surface thereof, a pair of telescoping bars each having a plurality of spaced apertures on the upper surface thereof, said bars being mounted one in each end of the tubular support member, locking means engaging corresponding apertures in the support member and telescoping bars to lock said members together at predetermined lengths, and, a pulley mounted to an end portion of each bar including a rope engaging the pulley, a stirrup for one's foot at one end of the rope and a handle at the other end of the rope.

2. A leg stretching exercise device in accordance with claim 1 wherein:

the spaced support members are joined to the support member extending along the plane of the backrest at one end and said support members each include a handle on the upwardly extending other end portion.

3. A leg stretching exercise device in accordance with claim 2 whereas:

the stirrups each include an upper rectangular ankle strap portion coupled to the rope and including fastening means thereon and a downwardly extending foot-loop portion.

4. A leg stretching exercise device in accordance with claim 2 wherein:

the locking means comprises a pin having a diameter less than that of the apertures and a length sufficient to project beyond the support members for ease of grasping, and, wherein the handles extend at an angle of approximately 70° from a vertical plane through the support members.

5. A leg stretching exercise device in accordance with claim 1 wherein:

the platform and the rear backrest comprise an integrally molded seat and said handles on the end of the rope each comprise a one-piece member contoured aperture for gripping purposes.

6. A leg stretching exercise device in accordance with claim 1 wherein:

the spaced support members terminate at the edge of the platform and the device further includes a separate handle member extending outwardly from the platform with the end portion thereof extending upwardly at an angle.

* * * * *